US011094021B2

(12) United States Patent
Zeldin et al.

(10) Patent No.: US 11,094,021 B2
(45) Date of Patent: Aug. 17, 2021

(54) PREDICTING LATENT METRICS ABOUT USER INTERACTIONS WITH CONTENT BASED ON COMBINATION OF PREDICTED USER INTERACTIONS WITH THE CONTENT

(71) Applicant: Facebook, Inc., Menlo Park, CA (US)

(72) Inventors: Robert Oliver Burns Zeldin, Los Altos, CA (US); Nathan John Davis, Woodside, CA (US); Anand Sumatilal Bhalgat, Mountain View, CA (US); Harsh Doshi, San Francisco, CA (US); Hao Song, Mountain View, CA (US)

(73) Assignee: Facebook, Inc., Menlo Park, CA (US)

( * ) Notice: Subject to any disclaimer, the term of this patent is extended or adjusted under 35 U.S.C. 154(b) by 1180 days.

(21) Appl. No.: 15/174,865

(22) Filed: Jun. 6, 2016

(65) Prior Publication Data

US 2017/0352109 A1 Dec. 7, 2017

(51) Int. Cl.
*G06Q 50/00* (2012.01)
*G06Q 30/08* (2012.01)

(52) U.S. Cl.
CPC ..... *G06Q 50/01* (2013.01); *G06Q 30/08* (2013.01)

(58) Field of Classification Search
USPC ..... 705/1.1, 14.41, 14.66; 709/219; 715/760; 704/230; 703/6, 11
See application file for complete search history.

(56) References Cited

U.S. PATENT DOCUMENTS 9,275,345 B1 * 3/2016 Song ..... G06F 21/552 703/11
2004/0220804 A1 * 11/2004 Odell ..... G10L 15/142 704/230
2009/0018983 A1 * 1/2009 El-Rafei ..... G06F 21/50 706/12
2014/0068011 A1 * 3/2014 Zhang ..... G06F 16/5846 709/219

(Continued)

OTHER PUBLICATIONS

"Hidden Markov Models", Blumsom, Aug. 19, 2004; www.pcbl@cs.mu.oz.au, pp. 1-7 (Year: 2004).*

(Continued)

*Primary Examiner* — Lynda Jasmin
*Assistant Examiner* — Kimberly L Evans
(74) *Attorney, Agent, or Firm* — BakerHostetler

(57) ABSTRACT

An online system presenting content items to a user generates a model that predicts a latent metric describing user actions that occur at least a reasonable amount of time after presentation of content items. To determine the latent metric, the online system retrieves one or more models predicting likelihoods of the user performing various interactions when presented with the content items and determines weights associated with different retrieved models. Combining the weighted retrieved models generates a model for determining the latent metric. As the retrieved models are based on data accessible to the online system in less than the reasonable amount of time after presenting content items, weighing the retrieved models allows the online system to predict the latent metric describing user actions occurring after content items are presented. When selecting content items for the user, the online system accounts for the latent metric determined by the generated model.

21 Claims, 3 Drawing Sheets

(56) References Cited

U.S. PATENT DOCUMENTS

| | | | | |
|---|---|---|---|---|
| 2014/0100835 | A1* | 4/2014 | Majumdar | G06N 3/00 703/11 |
| 2014/0108156 | A1* | 4/2014 | Hillerbrand | G06Q 50/01 705/14.66 |
| 2014/0330548 | A1* | 11/2014 | Appel | G06Q 50/01 703/6 |
| 2015/0007065 | A1* | 1/2015 | Krishnamoorthy | H04L 67/22 715/760 |
| 2015/0206170 | A1* | 7/2015 | Karande | G06Q 30/0249 705/14.41 |

OTHER PUBLICATIONS

"The Stochastic Modeling of Purchase Intentions and Behavior", Martin R. Young et al., Management Science, vol. 44 No. 2(Feb. 1998), pp. 188-202 http://www.jstor.org/stable/2634495 (Year: 1998).*
Phil Blunsom, Hidden Markov Models, Aug. 19, 2004, www.pcbl@cs.mu.oz.au pp. 1-7 (Year: 2004).*

* cited by examiner

PREDICTING LATENT METRICS ABOUT USER INTERACTIONS WITH CONTENT BASED ON COMBINATION OF PREDICTED USER INTERACTIONS WITH THE CONTENT

BACKGROUND

This disclosure relates generally to online systems, and more specifically to selecting content to online system users based on actions by the users at least a reasonable amount of time after presentation of the content.

Online systems, such as social networking systems, allow users to connect to and to communicate with other users of the online system. Users may create profiles on an online system that are tied to their identities and include information about the users, such as interests and demographic information. The users may be individuals or entities such as corporations or charities. Online systems allow users to easily communicate and to share content with other online system users by providing content to an online system for presentation to other users. Content provided to an online system by a user may be declarative information provided by a user, status updates, check-ins to locations, images, photographs, videos, text data, or any other information a user wishes to share with additional users of the online system. An online system may also generate content for presentation to a user, such as content describing actions taken by other users on the online system.

Additionally, many online systems commonly allow publishing users (e.g., businesses) to sponsor presentation of content on an online system to gain public attention for a user's products or services or to persuade other users to take an action regarding the publishing user's products or services. Content for which the online system receives compensation in exchange for presenting to users is referred to as "sponsored content." Many online systems receive compensation from a publishing user for presenting online system users with certain types of sponsored content provided by the publishing user. Frequently, online systems charge a publishing user for each presentation of sponsored content to an online system user or for each interaction with sponsored content by an online system user. For example, an online system receives compensation from a publishing user each time a content item provided by the publishing user is displayed to another user on the online system or each time another user is presented with a content item on the online system and interacts with the content item (e.g., selects a link included in the content item), or each time another user performs another action after being presented with the content item.

However, users providing content items to an online system may benefit more from user actions occurring greater than a reasonable amount of time after content items were presented to online system users. For example, changes in particular user actions over a relatively longer time interval between users who were presented with a content item and users who were not presented with a content item may provide a publishing user with a more accurate measure of the content item's effectiveness in achieving goals of a user providing a content item. As another example, user actions greater than a threshold amount of time after presentation of a content item allow a publishing user to generate content causing users to retain awareness of content for a longer duration. While conventional online systems often account for likelihoods of user interaction with content items when selecting content items, the conventional online systems merely account for likelihoods of interactions performed by users recently after presentation of content items, which may not accurately predict or account for actions by users greater than the reasonable amount of time after presentation of content.

SUMMARY

An online system receives content items for presentation to one or more users of the online system. Some of the content items include targeting criteria specifying characteristics of users eligible to be presented with the content items. Additionally, some content items may be associated with bid amounts that specify an amount of compensation received by the online system from a user associated with the content item in exchange for presenting the content items to one or more users. When the online system identifies an opportunity to present content items to a user, the online system selects content items for presentation to the user.

To select content items for presentation to the user, the online system maintains one or more models that determine likelihoods of users performing one or more interactions with content items. Different models determine likelihoods that a user would perform different interactions with content items if the user is presented with the content items. A model determines a likelihood of the user performing an interaction with a content item based on characteristics of the user (e.g., prior interactions performed by the user, characteristics of content items with which the user interacted, connections between the user and other users or objects, demographic information of the user, etc.) and characteristics of the content item (e.g., one or more topics associated with the content item, types of content included in the content item, etc.). Example models maintained by the online system include: a model determining a likelihood of a user accessing content item presented to the user, a model determining a likelihood of the user performing a specific interaction with a content item presented to the user (e.g., expressing a preference for the content item, sharing the content item with another user, commenting on the content item), a model determining a likelihood of the user performing a specific interaction with an object (e.g., a page, a user, etc.) associated with a content item presented to the user, a model determining an amount of time the user will view a content item presented to the user, or models predicting any other suitable interaction with a content item presented to the user.

However, the models maintained by the online system determine likelihoods that the user would perform interactions with a content item presented to the user that occur within a reasonable amount of time from presentation of the content item, while actions performed by the user after the reasonable amount of time from presentation of the content item may benefit a user who provided the content item to the user. For example, actions occurring after the reasonable amount of time from presentation of the content item are actions that have yet to occur (e.g., a user recalling seeing the content a particular time interval ago, a user taking an action or going to a physical location a threshold amount of time after viewing a content item). As another example, an action may occur after the reasonable amount of time from presentation of the content item because a third party system captures information describing the action and later communicates information describing the action to the online system. In another example, actions occurring after the reasonable amount of time occur greater than a threshold amount of time after presentation of the content item. For example, an increase in a particular user action (e.g., purchases of a product associated with the content item, downloads of an application associated with the content item, etc.) after presentation of the content item relative to occurrences of the particular user action without presentation of the content item may be more important to a user who provided the content item to the online system than interactions with the content item occurring closer in time to presentation of the content item. As other examples, purchases of a product associated with the content item six months after presentation of the content item or visits by users presented with the content item ten months after presentation of the content item may be actions that are valuable to the user providing the content item to the online system. Further, the models maintained by the online system may be unable to determine likelihoods of certain actions that are difficult to measure or for which the online system receives limited information without directly obtaining (e.g., prompting a user to identify if the user remembered seeing a particular content item), and such actions are also identified as actions that occur after the reasonable amount of time from presentation of a content item as used herein.

To account for an action performed by the user after the threshold time from presentation of the content item when selecting content for presentation to the user, the online system generates a model that determines a latent metric describing one or more user actions occurring greater than a reasonable amount of time from presentation of the content item, as described above. For example, the latent metric describes a likelihood of the performing a specific action (e.g., visiting a location, purchasing a product) after the reasonable amount of time after being presented with the content item. To generate a model determining a latent metric, the online system retrieves a plurality of the maintained models determining likelihoods of the user performing one or more interactions with the content item within the reasonable amount of time from presentation of the content item and determines weights associated with each of the retrieved models based on prior actions by users after being presented with one or more content items. In various embodiments, the online system determines weights associated with each of the retrieved models determining likelihoods of the user performing one or more interactions with the content item within the reasonable amount of time from presentation of the content item by applying one or more machine learned models to prior actions by one or more users and likelihoods of the users performing one or more interactions determined by the users who performed the actions. The online system may modify the weights associated with different retrieved models as the online system receives information identifying users who performed the action after the reasonable amount of time from presentation of the content item, allowing the generated model to more accurately determine the latent metric over time.

When the online system identifies an opportunity to present one or more content items to the user, the online system identifies content items eligible for presentation to the user and determines the latent metric for one or more of the identified content items using the generated model to determine the latent metric. In some embodiments, the online system determines the latent metric for each of the identified content items. The latent metric determined for an identified content item describes user actions occurring after the reasonable amount of time from presentation of the identified content item; for example, the latent metric identifies a probability of the user performing a specific action after the reasonable amount of time from presentation of the identified content item to the user. Based on the determined latent metrics, the online system selects one or more of the identified content items for presentation to the user and communicates the selected content items to a client device for presentation to the user. In some embodiments, the online system communicates a latent metric determined for an identified content item to a user who provided the identified content item to the online system, allowing the user who provided the identified content item to evaluate effectiveness of the content item in enticing other users to perform one or more actions after the reasonable amount of time from presentation of the content item to online system users.

In some embodiments, the online system selects one or more identified content items having at least a threshold latent metric for presentation. Alternatively, the online system ranks the identified content items based on the latent metrics and selects content items having at least a threshold position in the ranking for presentation to the user. In some embodiments, one or more of the identified content items are associated with bid amounts, where a bid amount associated with an identified content item specifies an amount of compensation the online system receives from a user who provided the content item to the online system in exchange for presenting the identified content item or in exchange for one or more user interactions after presentation of the identified content item. The online system modifies bid amounts associated with identified content items based on the latent metrics associated with the identified content items. For example, the online system increases bid amounts associated with identified content items having greater than a threshold latent metric and decreases bid amounts associated with identified content items having less than the threshold latent metric. Alternatively, the online system modifies bid amounts associated with identified content items by amounts that are proportional to latent metrics for the identified content items, so bid amounts associated with content items having higher latent metrics are increased by a larger amount. In some embodiments, the online system selects content items having greater than a threshold modified bid amount. Alternatively, the online system ranks identified content items based on their modified bid amounts and selects content items having at least a threshold position in the ranking.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

System Architecture

Figure 1:
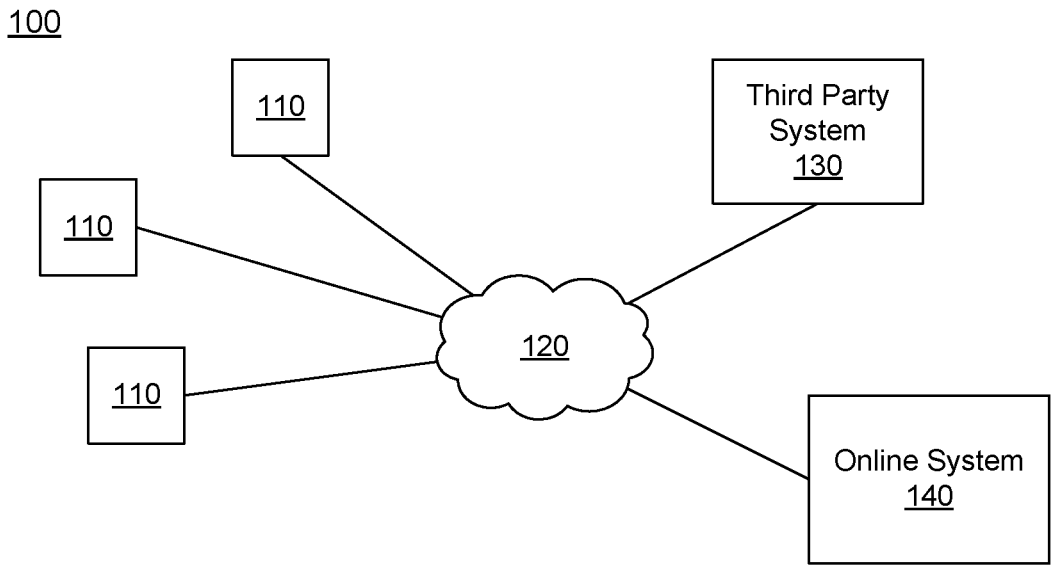
FIG. 1 is a block diagram of a system environment in which an online system operates, in accordance with an embodiment.

FIG. 1 is a block diagram of a system environment 100 for an online system 140. The system environment 100 shown by FIG. 1 comprises one or more client devices 110, a network 120, one or more third-party systems 130, and the online system 140. In alternative configurations, different and/or additional components may be included in the system environment 100. The embodiments described herein can be adapted to online systems that are social networking systems, content sharing networks, or other systems providing content to users.

The client devices 110 are one or more computing devices capable of receiving user input as well as transmitting and/or receiving data via the network 120. In one embodiment, a client device 110 is a conventional computer system, such as a desktop or a laptop computer. Alternatively, a client device 110 may be a device having computer functionality, such as a personal digital assistant (PDA), a mobile telephone, a smartphone, a smartwatch or another suitable device. In one embodiment, a client device 110 executes an application allowing a user of the client device 110 to interact with the online system 140. For example, a client device 110 executes a browser application to enable interaction between the client device 110 and the online system 140 via the network 120. In another embodiment, a client device 110 interacts with the online system 140 through an application programming interface (API) running on a native operating system of the client device 110, such as IOS® or ANDROID™.

The client devices 110 are configured to communicate via the network 120, which may comprise any combination of local area and/or wide area networks, using both wired and/or wireless communication systems. In one embodiment, the network 120 uses standard communications technologies and/or protocols. For example, the network 120 includes communication links using technologies such as Ethernet, 802.11, worldwide interoperability for microwave access (WiMAX), 3G, 4G, code division multiple access (CDMA), digital subscriber line (DSL), etc. Examples of networking protocols used for communicating via the network 120 include multiprotocol label switching (MPLS), transmission control protocol/Internet protocol (TCP/IP), hypertext transport protocol (HTTP), simple mail transfer protocol (SMTP), and file transfer protocol (FTP). Data exchanged over the network 120 may be represented using any suitable format, such as hypertext markup language (HTML) or extensible markup language (XML). In some embodiments, all or some of the communication links of the network 120 may be encrypted using any suitable technique or techniques.

One or more third party systems 130 may be coupled to the network 120 for communicating with the online system 140, which is further described below in conjunction with FIG. 2. In one embodiment, a third party system 130 is an application provider communicating information describing applications for execution by a client device 110 or communicating data to client devices 110 for use by an application executing on the client device. In other embodiments, a third party system 130 provides content or other information for presentation via a client device 110. A third party system 130 may also communicate information to the online system 140, such as advertisements, content, or information about an application provided by the third party system 130. In some embodiments, one or more of the third party systems 130 provide content to the online system 140 for presentation to users of the online system 140 and provide compensation to the online system 140 in exchange for presenting the content. For example, a third party system 130 provides content items associated with amounts of compensation provided by the third party system 130 to the online system 140 in exchange presenting the content items to users of the online system 140

Figure 2:
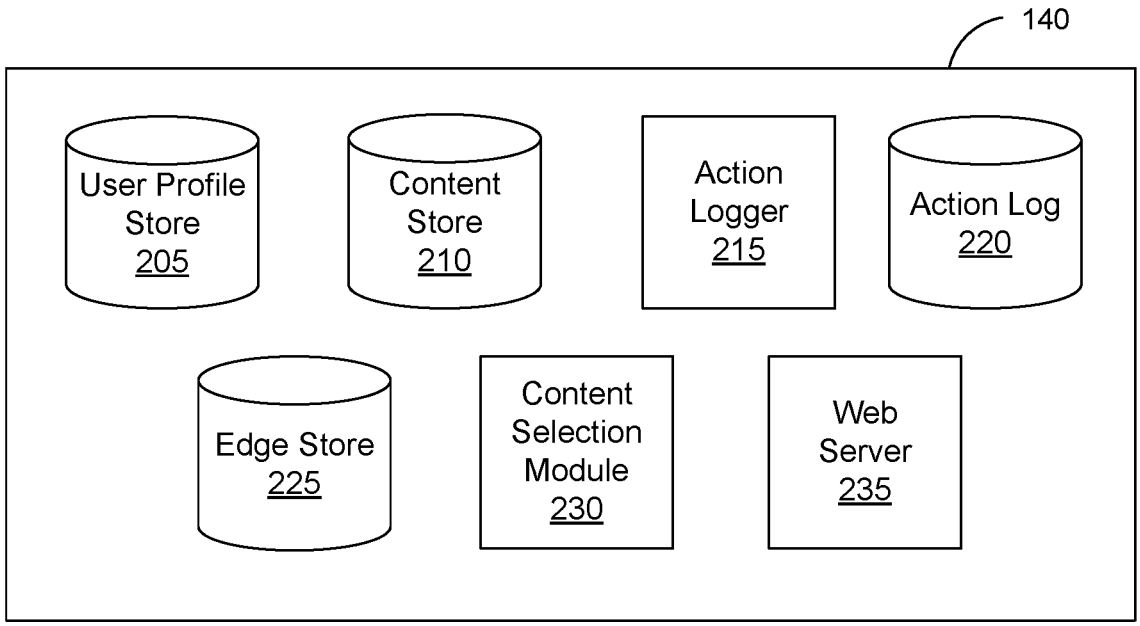
FIG. 2 is a block diagram of an online system, in accordance with an embodiment.

FIG. 2 is a block diagram of architecture of the online system 140. The online system 140 shown in FIG. 2 includes a user profile store 205, a content store 210, an action logger 215, an action log 220, an edge store 225, a content selection module 230, and a web server 235. In other embodiments, the online system 140 may include additional, fewer, or different components for various applications. Conventional components such as network interfaces, security functions, load balancers, failover servers, management and network operations consoles, and the like are not shown so as to not obscure the details of the system architecture.

Each user of the online system 140 is associated with a user profile, which is stored in the user profile store 205. A user profile includes declarative information about the user that was explicitly shared by the user and may also include profile information inferred by the online system 140. In one embodiment, a user profile includes multiple data fields, each describing one or more attributes of the corresponding online system user. Examples of information stored in a user profile include biographic, demographic, and other types of descriptive information, such as work experience, educational history, gender, hobbies or preferences, location and the like. A user profile may also store other information provided by the user, for example, images or videos. In certain embodiments, images of users may be tagged with information identifying the online system users displayed in an image, with information identifying the images in which a user is tagged stored in the user profile of the user. A user profile in the user profile store 205 may also maintain references to actions by the corresponding user performed on content items in the content store 210 and stored in the action log 220.

While user profiles in the user profile store 205 are frequently associated with individuals, allowing individuals to interact with each other via the online system 140, user profiles may also be stored for entities such as businesses or organizations. This allows an entity to establish a presence on the online system 140 for connecting and exchanging content with other online system users. The entity may post information about itself, about its products or provide other information to users of the online system 140 using a brand page associated with the entity's user profile. Other users of the online system 140 may connect to the brand page to receive information posted to the brand page or to receive information from the brand page. A user profile associated with the brand page may include information about the entity itself, providing users with background or informational data about the entity.

The content store 210 stores objects that each represent various types of content. Examples of content represented by an object include a page post, a status update, a photograph, a video, a link, a shared content item, a gaming application achievement, a check-in event at a local business, a brand page, or any other type of content. Online system users may create objects stored by the content store 210, such as status updates, photos tagged by users to be associated with other objects in the online system 140, events, groups or applications. In some embodiments, objects are received from third-party applications or third-party applications separate from the online system 140. In one embodiment, objects in the content store 210 represent single pieces of content, or content "items." Hence, online system users are encouraged to communicate with each other by posting text and content items of various types of media to the online system 140 through various communication channels. This increases the amount of interaction of users with each other and increases the frequency with which users interact within the online system 140.

One or more content items included in the content store 210 include content for presentation to a user and a bid amount. The content is text, image, audio, video, or any other suitable data presented to a user. In various embodiments, the content also includes a landing page specifying a network address to which a user is directed when the content item is accessed. The bid amount is included in a content item by a user and is used to determine an expected value, such as monetary compensation, provided by an advertiser to the online system 140 if content in the content item is presented to a user, if the content in the content item receives a user interaction when presented, or if any suitable condition is satisfied when content in the content item is presented to a user. For example, the bid amount included in a content item specifies a monetary amount that the online system 140 receives from a user who provided the content item to the online system 140 if content in the content item is displayed. In some embodiments, the expected value to the online system 140 of presenting the content from the content item may be determined by multiplying the bid amount by a probability of the content of the content item being accessed by a user.

Various content items may include an objective identifying an interaction that a user associated with a content item desires other users to perform when presented with content included in the content item. Example objectives include: installing an application associated with a content item, indicating a preference for a content item, sharing a content item with other users, interacting with an object associated with a content item, or performing any other suitable interaction. As content from a content item is presented to online system users, the online system 140 logs interactions between users presented with the content item or with objects associated with the content item. Additionally, the online system 140 receives compensation from a user associated with content item as online system users perform interactions with a content item that satisfy the objective included in the content item.

Additionally, a content item may include one or more targeting criteria specified by the user who provided the content item to the online system 140. Targeting criteria included in a content item request specify one or more characteristics of users eligible to be presented with the content item. For example, targeting criteria are used to identify users having user profile information, edges, or actions satisfying at least one of the targeting criteria. Hence, targeting criteria allow a user to identify users having specific characteristics, simplifying subsequent distribution of content to different users.

In one embodiment, targeting criteria may specify actions or types of connections between a user and another user or object of the online system 140. Targeting criteria may also specify interactions between a user and objects performed external to the online system 140, such as on a third party system 130. For example, targeting criteria identifies users that have taken a particular action, such as sent a message to another user, used an application, joined a group, left a group, joined an event, generated an event description, purchased or reviewed a product or service using an online marketplace, requested information from a third party system 130, installed an application, or performed any other suitable action. Including actions in targeting criteria allows users to further refine users eligible to be presented with content items. As another example, targeting criteria identifies users having a connection to another user or object or having a particular type of connection to another user or object.

The action logger 215 receives communications about user actions internal to and/or external to the online system 140, populating the action log 220 with information about user actions. Examples of actions include adding a connection to another user, sending a message to another user, uploading an image, reading a message from another user, viewing content associated with another user, and attending an event posted by another user. In addition, a number of actions may involve an object and one or more particular users, so these actions are associated with the particular users as well and stored in the action log 220.

The action log 220 may be used by the online system 140 to track user actions on the online system 140, as well as actions on third party systems 130 that communicate information to the online system 140. Users may interact with various objects on the online system 140, and information describing these interactions is stored in the action log 220. Examples of interactions with objects include: commenting on posts, sharing links, checking-in to physical locations via a client device 110, accessing content items, and any other suitable interactions. Additional examples of interactions with objects on the online system 140 that are included in the action log 220 include: commenting on a photo album, communicating with a user, establishing a connection with an object, joining an event, joining a group, creating an event, authorizing an application, using an application, expressing a preference for an object ("liking" the object), and engaging in a transaction. Additionally, the action log 220 may record a user's interactions with content items on the online system 140 as well as with other applications operating on the online system 140. In some embodiments, data from the action log 220 is used to infer interests or preferences of a user, augmenting the interests included in the user's user profile and allowing a more complete understanding of user preferences.

The action log 220 may also store user actions taken on a third party system 130, such as an external website, and communicated to the online system 140. For example, an e-commerce website may recognize a user of an online system 140 through a social plug-in enabling the e-commerce website to identify the user of the online system 140. Because users of the online system 140 are uniquely identifiable, e-commerce websites, such as in the preceding example, may communicate information about a user's actions outside of the online system 140 to the online system 140 for association with the user. Hence, the action log 220 may record information about actions users perform on a third party system 130, including webpage viewing histories, content items that were engaged, purchases made, and other patterns from shopping and buying. Additionally, actions a user performs via an application associated with a third party system 130 and executing on a client device 110 may be communicated to the action logger 215 by the application for recordation and association with the user in the action log 220.

In one embodiment, the edge store 225 stores information describing connections between users and other objects on the online system 140 as edges. Some edges may be defined by users, allowing users to specify their relationships with other users. For example, users may generate edges with other users that parallel the users' real-life relationships, such as friends, co-workers, partners, and so forth. Other edges are generated when users interact with objects in the online system 140, such as expressing interest in a page on the online system 140, sharing a link with other users of the online system 140, and commenting on posts made by other users of the online system 140.

In one embodiment, an edge may include various features each representing characteristics of interactions between users, interactions between users and objects, or interactions between objects. For example, features included in an edge describe a rate of interaction between two users, how recently two users have interacted with each other, a rate or an amount of information retrieved by one user about an object, or numbers and types of comments posted by a user about an object. The features may also represent information describing a particular object or user. For example, a feature may represent the level of interest that a user has in a particular topic, the rate at which the user logs into the online system 140, or information describing demographic information about the user. Each feature may be associated with a source object or user, a target object or user, and a feature value. A feature may be specified as an expression based on values describing the source object or user, the target object or user, or interactions between the source object or user and target object or user; hence, an edge may be represented as one or more feature expressions.

The edge store 225 also stores information about edges, such as affinity scores for objects, interests, and other users. Affinity scores, or "affinities," may be computed by the online system 140 over time to approximate a user's interest in an object or in another user in the online system 140 based on the actions performed by the user. A user's affinity may be computed by the online system 140 over time to approximate the user's interest in an object, in a topic, or in another user in the online system 140 based on actions performed by the user. Computation of affinity is further described in U.S. patent application Ser. No. 12/978,265, filed on Dec. 23, 2010, U.S. patent application Ser. No. 13/690,254, filed on Nov. 30, 2012, U.S. patent application Ser. No. 13/689,969, filed on Nov. 30, 2012, and U.S. patent application Ser. No. 13/690,088, filed on Nov. 30, 2012, each of which is hereby incorporated by reference in its entirety. Multiple interactions between a user and a specific object may be stored as a single edge in the edge store 225, in one embodiment. Alternatively, each interaction between a user and a specific object is stored as a separate edge. In some embodiments, connections between users may be stored in the user profile store 205, or the user profile store 205 may access the edge store 225 to determine connections between users.

The content selection module 230 selects one or more content items for communication to a client device 110 to be presented to a user. Content items eligible for presentation to the user are retrieved from the content store 210 or from another source by the content selection module 230, which selects one or more of the content items for presentation to the viewing user. A content item eligible for presentation to the user is a content item associated with at least a threshold number of targeting criteria satisfied by characteristics of the user or is a content item that is not associated with targeting criteria. In various embodiments, the content selection module 230 includes content items eligible for presentation to the user in one or more selection processes, which identify a set of content items for presentation to the user. For example, the content selection module 230 determines measures of relevance of various content items to the user based on characteristics associated with the user by the online system 140 and based on the user's affinity for different content items. Based on the measures of relevance, the content selection module 230 selects content items for presentation to the user. As an additional example, the content selection module 230 selects content items having the highest measures of relevance or having at least a threshold measure of relevance for presentation to the user. Alternatively, the content selection module 230 ranks content items based on their associated measures of relevance and selects content items having the highest positions in the ranking or having at least a threshold position in the ranking for presentation to the user.

Content items eligible for presentation to the user may include content items associated with bid amounts. The content selection module 230 uses the bid amounts associated with ad requests when selecting content for presentation to the user. In various embodiments, the content selection module 230 determines an expected value associated with various ad requests (or other content items) based on their bid amounts and selects content items associated with a maximum expected value or associated with at least a threshold expected value for presentation. An expected value associated with a content item represents an expected amount of compensation to the online system 140 for presenting the content item. For example, the expected value associated with a content item is a product of the ad request's bid amount and a likelihood of the user interacting with the content item. The content selection module 230 may rank content items based on their associated bid amounts and select content items having at least a threshold position in the ranking for presentation to the user. In some embodiments, the content selection module 230 ranks both content items not associated with bid amounts and content items associated with bid amounts in a unified ranking based on bid amounts and measures of relevance associated with content items. Based on the unified ranking, the content selection module 230 selects content for presentation to the user. Selecting content items associated with bid amounts and content items not associated with bid amounts through a unified ranking is further described in U.S. patent application Ser. No. 13/545,266, filed on Jul. 10, 2012, which is hereby incorporated by reference in its entirety.

The content selection module 230 maintains various models that each predict a likelihood of a user performing one or more interactions with a content item (or determining any other suitable value describing interaction with the content item). Models maintained by the content selection module 230 determine likelihoods of a user interacting with a content item based on characteristics of the user and characteristics of the content item. Example models maintained by the content selection module 230 determine a likelihood of a user accessing content item presented to the user, determine a likelihood of the user performing a specific interaction with a content item presented to the user (e.g., expressing a preference for the content item, sharing the content item with another user, commenting on the content item), determine a likelihood of the user performing a specific interaction with an object (e.g., a page, a user, etc.) associated with a content item presented to the user, determine an amount of time the user will view a content item presented to the user, determine any other suitable interaction or likelihood of interaction with a content item presented to the user.

Although models maintained by the content selection module 230 determine likelihoods of the user performing interactions with a content item within a threshold time from presentation of the content item, various actions users performed after the threshold time from presentation of the content item are beneficial to a user who provided the presented content item to the online system 140. For example, a user providing the presented content item to the online system 140 may benefit from an increase in occurrences of a particular user action (e.g., purchases of a product associated with the content item, downloads of an application associated with the content item, etc.) by users who were presented with the content item relative to occurrences of the particular user action by users to whom the content item was presented. Increasing the particular user action occurring after the reasonable amount of time from presentation of a content item to users may provide a greater benefit to the user who provided the presented content item to the online system 140 than interactions by users closer in time to presentation of the content item. Further, the models maintained by the online system 140 may be unable to determine likelihoods of certain actions that are difficult to measure or for which the online system receives limited information without directly requesting the information (e.g., prompting a user to identify if the user remembered seeing a particular content item), and such actions are also identified as actions that occur after the reasonable amount of time, as used herein.

To account for actions by users at least a reasonable amount of time after presentation of content items when selecting content items, the content selection module 230 generates a model determining a latent metric describing one or more user actions occurring at least the reasonable amount of time from presentation of the content item and uses the latent metric when selecting content items for presentation to a user. As further described below in conjunction with FIGS. 3 and 4, the content selection module 230 generates the model determining the latent metric by determining weights associated with various models maintained by the content selection module 230 and combining the weighted models. In various embodiments, the content selection module applies one or more machine learned models to values determined by various maintained models for users who performed certain actions to determine weights associated with different maintained models. As an example, the combination of weighted models determines a latent metric describing a likelihood of a user performing a specific action (e.g., visiting a location, purchasing a product) at least the reasonable amount of time after being presented with the content item. Generation of the latent metric and selection of content based on the latent metric is further described below in conjunction with FIGS. 3 and 4.

For example, the content selection module 230 receives a request to present a feed of content to a user of the online system 140. The feed may include one or more content items associated with bid amounts and other content items, such as stories describing actions associated with other online system users connected to the user, which are not associated with bid amounts. The content selection module 230 accesses one or more of the user profile store 205, the content store 210, the action log 220, and the edge store 225 to retrieve information about the user. For example, information describing actions associated with other users connected to the user or other data associated with users connected to the user are retrieved. Content items from the content store 210 are retrieved and analyzed by the content selection module 230 to identify candidate content items eligible for presentation to the user. For example, content items associated with users who not connected to the user or stories associated with users for whom the user has less than a threshold affinity are discarded as candidate content items. Based on various criteria, the content selection module 230 selects one or more of the content items identified as candidate content items for presentation to the identified user. The selected content items are included in a feed of content that is presented to the user. For example, the feed of content includes at least a threshold number of content items describing actions associated with users connected to the user via the online system 140.

In various embodiments, the content selection module 230 presents content to a user through a newsfeed including a plurality of content items selected for presentation to the user. One or more content items may also be included in the feed. The content selection module 230 may also determine the order in which selected content items are presented via the feed. For example, the content selection module 230 orders content items in the feed based on likelihoods of the user interacting with various content items.

The web server 235 links the online system 140 via the network 120 to the one or more client devices 110, as well as to the one or more third party systems 130. The web server 235 serves web pages, as well as other content, such as JAVA®, FLASH®, XML and so forth. The web server 235 may receive and route messages between the online system 140 and the client device 110, for example, instant messages, queued messages (e.g., email), text messages, short message service (SMS) messages, or messages sent using any other suitable messaging technique. A user may send a request to the web server 235 to upload information (e.g., images or videos) that are stored in the content store 210. Additionally, the web server 235 may provide application programming interface (API) functionality to send data directly to native client device operating systems, such as IOS®, ANDROID™, or BlackberryOS.

Figure 3:
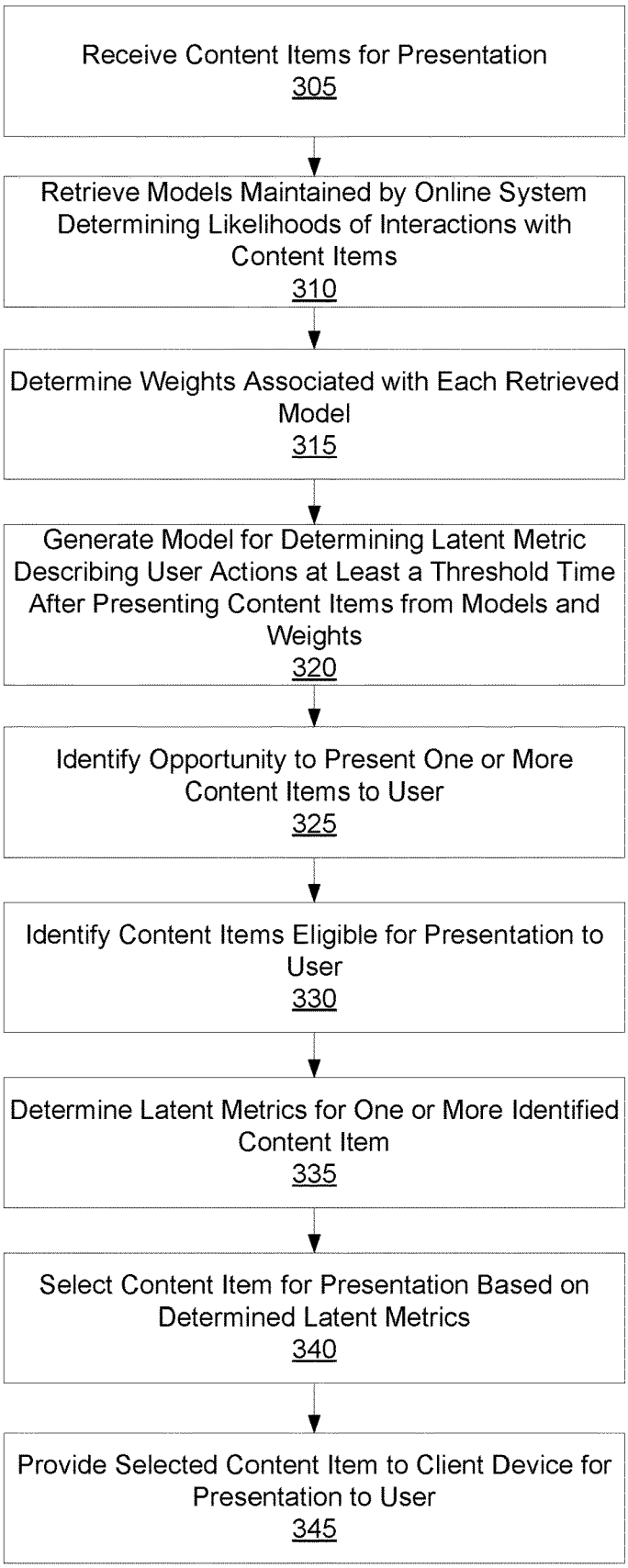
FIG. 3 is a flowchart of a method for selecting content items for presentation to a user based on actions by the user after a reasonable amount of time after presentation of the content items, in accordance with an embodiment.

Selecting Content Based on User Actions at Least a Reasonable Amount of Time after Content Presentation FIG. 3 is a flowchart of one embodiment of a method for selecting content items for presentation to a user based on actions by the user after a reasonable amount of time after presentation of the content items. In other embodiments, the method may include different and/or additional steps than those shown in FIG. 3. Additionally, steps of the method may be performed in different orders than the order described in conjunction with FIG. 3 in various embodiments.

An online system 140 receives 305 content items for presentation to one or more users of the online system 140. Some of the content items include targeting criteria specifying characteristics of users eligible to be presented with the content items. As described above in conjunction with FIG. 2, a content item including targeting criteria is eligible to be presented to users having characteristics satisfying at least a threshold number of the targeting criteria. Additionally, some content items may be associated with bid amounts, where a bid amount associated with a content item specifies an amount of compensation received by the online system 140 from a user associated with the content item in exchange for presenting the content items to one or more users.

To select content items for presentation to the user, the online system 140 maintains one or more models that determine likelihoods of users performing one or more interactions with content items. As further described above in conjunction with FIG. 2, different models determine likelihoods of the user performing different interactions with content items. A model determines a likelihood of the user performing an interaction with a content item based on characteristics of the user (e.g., prior interactions performed by the user, characteristics of content items with which the user interacted, connections between the user and other users or objects, demographic information of the user, etc.) and characteristics of the content item (e.g., one or more topics associated with the content item, types of content included in the content item, etc.). Example models maintained by the online system 140 determine a likelihood of a user accessing content item presented to the user, determine a likelihood of the user performing a specific interaction with a content item presented to the user (e.g., expressing a preference for the content item, sharing the content item with another user, commenting on the content item), determine a likelihood of the user performing a specific interaction with an object (e.g., a page, a user, etc.) associated with a content item presented to the user, determine an amount of time the user will view a content item presented to the user, or determine any other suitable interaction or likelihood of interaction with a content item presented to the user.

However, the models maintained by the online system 140 determine likelihoods that users would perform interactions with content items presented to the users that occur within a reasonable amount of time from presentation of the content item, while actions performed by the users after the reasonable amount of time from presentation of the content item may benefit a user who provided the content item to the user. For example, actions occurring after the reasonable amount of time from presentation of the content item are actions that have yet to occur (e.g., a user recalling seeing the content a particular time interval ago, a user taking an action or going to a physical location a threshold amount of time after viewing a content item). As another example, an action may occur after the reasonable amount of time from presentation of the content item because a third party system captures information describing the action and later communicates information describing the action to the online system. In another example, actions occurring after the reasonable amount of time occur greater than a threshold amount of time after presentation of the content item. For example, an increase in a particular user action (e.g., purchases of a product associated with the content item, downloads of an application associated with the content item, etc.) after presentation of the content item relative to occurrences of the particular user action without presentation of the content item may be more important to a user who provided the content item to the online system 140 than interactions with the content item occurring closer in time to presentation of the content item. As other examples, purchases of a product associated with a content item six months after presentation of the content item or visits by users presented with the content item ten months after presentation of the content item may be actions that are valuable to the user providing the content item to the online system 140 that occur after the reasonable amount of time from presentation of the content item. Hence, increasing one or more interactions by users with a presented content item after the reasonable amount of time from presentation of the content item may provide a greater benefit to the user who provided the presented content item to the online system 140 than users sharing the content item, expressing a preference for the content item, or performing other actions closer in time to presentation of the content item. To account for an action performed by the user after the threshold time from presentation of the content item when selecting content for presentation to users, the online system 140 retrieves 310 the one or more models that determine likelihoods of users performing one or more interactions with content items within the reasonable amount of time after presentation of content items and determines 315 weights associated with each of the retrieved one or more models. Based on the retrieved one or more models and the determined weights, the online system 140 generates 320 a model determining a latent metric describing one or more user actions by users occurring after the reasonable amount of time after presentation of a content item. For example, the latent metric describes a likelihood of a user performing a specific action (e.g., visiting a location, purchasing a product) after the reasonable amount of time after being presented with the content item. The generated model weights different models predicting likelihoods of users performing different interactions with a content item within the reasonable amount of time from presentation of the content item and combines the weighted models to determine the latent metric describing a user action that occurs after the reasonable amount of time after presentation of the content item to the user.

In various embodiments, the online system 140 determines 315 weights associated with different retrieved models predicting likelihoods of users performing different interactions with a content item within the reasonable amount of time from presentation of the content item by applying one or more machine learned models to values generated by different retrieved models for users who performed performing one or more interactions when presented with content items having various characteristics. For example, the online system 140 determines 315 weights associated with each retrieved model based on prior actions by users that are similar to an action associated with the latent metric, characteristics of users who performed the prior actions, and likelihoods of the users performing various interactions determined by different retrieved models. The online system 140 may modify weights associated with different retrieved models as the online system 140 receives information identifying users who performed the action after the reasonable amount of time from presentation of a content item, allowing the generated model to more accurately determine the latent metric over time.

Because the model determining the latent metric describing one or more user actions by users occurring after the reasonable amount of time after presentation of the content item is a combination of models that determine likelihoods of users performing various actions within the reasonable amount of time after presentation of the content item, the model determining the latent metric describing one or more user actions by users occurring after the reasonable amount of time after presentation of the content item may be trained or re-trained in near real-time or in-real time. Similarly, generating 320 the model determining the latent metric describing one or more user actions by users occurring after the reasonable amount of time after presentation of the content item from models that determine likelihoods of users performing actions within the reasonable amount of time after presentation of the content item allows the online system 140 to generate 320 the model determining the latent metric when there is a request to use the latent metric or a potential use of the latent metric. This allows the model determining the latent metric to be retrained for a particular content item based on actions with a the particular content item occurring within the reasonable amount of time from presentation of the content item, which are accounted for by the models determining likelihoods of users performing actions within the reasonable amount of time of presentation of the particular content item; conventional approaches do not allow such retraining of latent metric determination, as presentation of the particular content item is often stopped by the time the online system 140 obtains results of the latent matric for the particular content item.

Figure 4:
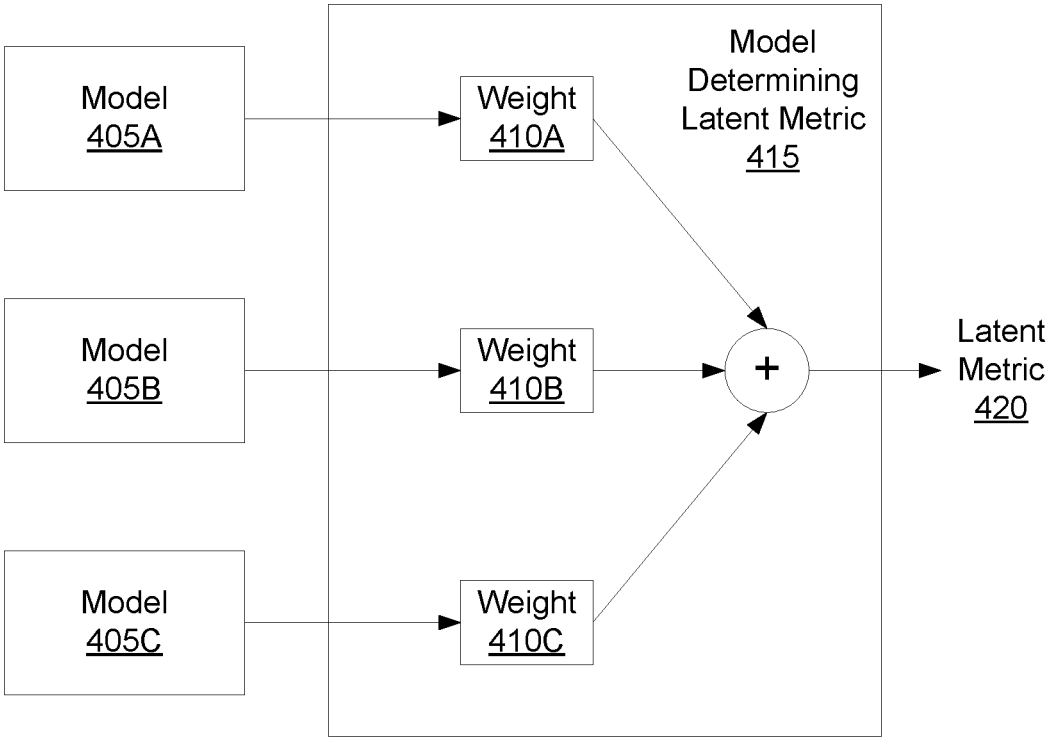
FIG. 4 is a process flow diagram of generating a model determining latent metric describing actions by one or more users occurring after a reasonable amount of time after presentation of a content item, in accordance with an embodiment.

FIG. 4 is a process flow diagram of one embodiment of generating a model determining a latent metric describing actions by one or more users occurring after a reasonable amount of time after presentation of a content item. In the example of FIG. 4, models 405A-405C determine likelihoods of users performing interactions within a reasonable amount of time after presentation of a content item based on characteristics of users and characteristics of the content item. For example, model 405A determines a likelihood of a user accessing a content item, model 405B determines a likelihood of a user commenting on the content item, and model 405C predicts an amount of time a user will view the content item. Based on prior actions by users with content items and likelihoods or other values determined for the users who performed the actions by models 405A-405C, the online system 140 generates weights 410A-410C, with a weight associated with a model 405A-405C. In the example shown by FIG. 4, a weight 410A-410C is associated with each model 405A-405C. For example, weight 410A is associated with model 405A, weight 410B is associated with model 405B, and weight 410C is associated with model 405C. In various embodiments, the online system 140 applies one or more machine learned models to characteristics of users and to likelihoods or other values determined by different models 405A-405C for the users to generate the weights 410A-410C.

As shown in FIG. 4, the online system 140 combines the models 405A-405C after applying weights 410A-410C to the corresponding models 405A-405C to generate a model 415 determining a latent metric describing actions by one or more users occurring after a reasonable amount of time after presentation of a content item. In the example of FIG. 4, the model 415 weights likelihoods or other values from different models 405A-405C by weights 410A-410C corresponding to models 405A-405C generating the respective likelihoods or other values and sums the weighted likelihoods or other values from models 405A-405C to determine the latent metric 420 describing actions by one or more users occurring after the reasonable amount of time after presentation of a content item. For example, the latent metric 420 describes a likelihood of a user performing a particular action (e.g., purchasing a product, visiting a location) after the reasonable amount of time after presentation of the content item to the user.

In various embodiments, the online system 140 modifies the weights 410A-410C over time as users perform actions after the reasonable amount of time after presentation of content items to users. For example, after the reasonable amount of time after presentation of content items to users has lapsed, when the online system 140 receives information identifying a user has performed an action for which a likelihood is determined by the latent metric 420, the online system 140 modifies one or more of the weights 410A-410C corresponding to on likelihoods or other values determined by one or more of the models 405A-405C for the user. This allows the online system 140 to improve the accuracy of the model 415 determining the latent metric describing actions by one or more users occurring after the reasonable amount of time after presentation of the content item as users perform the one or more actions after the reasonable amount of time after presentation of the content item.

Referring again to FIG. 3, when the online system 140 identifies 325 an opportunity to present one or more content items to the user, the online system 140 identifies 330 content items eligible for presentation to the user. As an example, the online system 140 identifies 325 the opportunity to present one or more content items to the user when the online system 140 receives a request for content from a client device 110 associated with the user. The online system 140 identifies 330 content items that do not include targeting criteria or that include at least a threshold number of targeting criteria satisfied by characteristics of the user as eligible for presentation to the user.

Using the generated model, the online system 140 determines 335 the latent metric for one or more of the identified content items. In some embodiments, the online system 140 determines 335 the latent metric for each of the identified content items. The latent metric determined for an identified content item describes one or more actions by the user occurring after the reasonable amount of time after presentation of the identified content item. For example, the latent metric identifies a probability of the user performing a specific action after the reasonable amount of time after being presented with the identified content item; as a specific example, the latent metric identifies a probability of the user purchasing a product after the reasonable amount of time after being presented with the identified content item. Based on the determined latent metrics for various identified content items, the online system 140 selects 340 one or more of the identified content items for presentation to the user and provides 345 the selected content items to a client device 110 for presentation to the user. Additionally, the online system 140 may also communicate a latent metric determined for an identified content item to a user who provided the identified content item to the online system 140, allowing the user who provided the identified content item to evaluate effectiveness of the content item in enticing other users to perform one or more actions after the reasonable amount of time from presentation of the content item to online system users.

In some embodiments, the online system 140 selects 340 one or more identified content items having at least a threshold latent metric. Alternatively, the online system 140 ranks the identified content items based on their latent metrics and selects 340 content items having at least a threshold position in the ranking. In some embodiments, one or more of the identified content items are associated with bid amounts, where a bid amount associated with an identified content item specifies an amount of compensation the online system 140 receives from a user who provided the content item to the online system 140 in exchange for presenting the identified content item or in exchange for one or more user interactions after presentation of the identified content item. Based on latent metrics associated with identified content items, the online system 140 modifies bid amounts associated with identified content items. For example, the online system 140 increases bid amounts associated with identified content items having greater than a threshold latent metric and decreases bid amounts associated with identified content items having less than the threshold latent metric. Alternatively, the online system 140 modifies bid amounts associated with identified content items by amounts that are proportional to latent metrics for the identified content items, so bid amounts associated with content items having higher latent metrics are increased by a larger amount. In some embodiments, the online system 140 selects 340 content items having greater than a threshold modified bid amount. Alternatively, the online system 140 ranks identified content items based on their modified bid amounts and selects 340 content items having at least a threshold position in the ranking.

SUMMARY

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

receiving content items at an online system for presentation to users of the online system;

retrieving models maintained by the online system for determining likelihoods of users performing one or more interactions with presented content items within a threshold amount of time after presentation of the presented content items based on characteristics of the users and characteristics of content items;

determining weights associated with each of the retrieved models based on prior actions by users after presentation of content items to users of the online system;

generating a model for determining a latent metric describing user actions occurring after the threshold amount of time after presentation of content items by applying the weights to the retrieved models associated with the weights and combining the retrieved models after application of the weights;

identifying an opportunity to present one or more content items to the user;

identifying content items eligible for presentation to the user from the received content items;

determining the latent metric describing user actions occurring after the threshold amount of time after presentation of an identified content item for each identified content item using the model for determining the latent metric describing user actions occurring after the threshold amount of time after presentation of content items;

selecting a content item of the identified content items for presentation to the user based on the determined latent metrics; and providing the selected content item to a client device for presentation to the user.

2. The method of claim 1, wherein determining the latent metric describing user actions occurring after the threshold amount of time after presentation of an identified content item for each identified content item comprises:

determining likelihoods of the user performing one or more interactions with the identified content item from the retrieved models, characteristics of the user, and characteristics of the identified content item;

for each of the retrieved models, applying a weight associated with a model to a likelihood of the user performing a determined likelihood of the user performing the interaction associated with the model; and combining the determined likelihoods of the user performing one or more interactions with the identified content item after application of the weights to determine the latent metric describing user actions occurring after the threshold amount of time after presentation of the identified content item.

3. The method of claim 2, wherein combining the determined likelihoods of the user performing one or more interactions with the identified content item after application of the weights comprises determining a sum of the determined likelihoods of the user performing one or more interactions with the identified content item after application of the weights.

4. The method of claim 1, wherein selecting the content item of the identified content items for presentation to the user based on the determined latent metrics comprises:

ranking the identified content items based on the determined latent metrics; and selecting an identified content item having at least a threshold position in the ranking.

5. The method of claim 1, wherein selecting the content item of the identified content items for presentation to the user based on the determined latent metrics comprises:

selecting an identified content item having a maximum latent metric.

6. The method of claim 1, wherein one or more of the identified content items are associated with bid amounts specifying amounts of compensation provided to the online system for presenting the one or more identified content items.

7. The method of claim 6, wherein selecting the content item of the identified content items for presentation to the user based on the determined latent metrics comprises:

modifying amounts associated with the one or more identified content items based on the determined latent metrics, wherein a bid amount is associated with an identified content item modified by an amount that is proportional to the determined latent metric for the identified content item; and selecting the content item of the identified content items based on the modified bid amount.

8. The method of claim 7, wherein selecting the content item of the identified content items based on the modified bid amount comprises:

selecting an identified content item associated with a maximum modified bid amount.

9. The method of claim 7, wherein selecting the content item of the identified content items based on the modified bid amount comprises:

ranking the one or more identified content items based on the modified bid amount associated with the one or more identified content items; and selecting an identified content item having at least a threshold position in the ranking.

10. The method of claim 1, wherein a model maintained by the online system for determining a likelihood of users performing an interaction with a presented content item within the threshold amount of time after presentation of the presented content items is selected from a group consisting of: a model determining a likelihood of users accessing the presented content item, a model determining a likelihood of users performing a specific interaction with the presented content item, a model determining a likelihood of users performing a specific interaction with an object associated with the presented content item, a model determining an amount of time users will view the presented content item, and any combination thereof.

11. The method of claim 1, wherein a user action occurring after the threshold amount of time after presentation of content items comprises an action for which the online system receives limited information without directly requesting the information from one or more users.

12. A computer program product comprising a non-transitory computer readable storage medium having instructions encoded thereon that, when executed by a processor, cause the processor to:

receive content items at an online system for presentation to users of the online system;

retrieve models maintained by the online system for determining likelihoods of users performing one or more interactions with presented content items within a threshold amount of time after presentation of the presented content items based on characteristics of the users and characteristics of content items;

determine weights associated with each of the retrieved models based on prior actions by users after presentation of content items to users of the online system;

generate a model for determining a latent metric describing user actions occurring after the threshold amount of time after presentation of content items by applying the weights to the retrieved models associated with the weights and combining the retrieved models after application of the weights;

identify an opportunity to present one or more content items to the user;

identify content items eligible for presentation to the user from the received content items;

determine the latent metric describing user actions occurring after the threshold amount of time after presentation of an identified content item for each identified content item using the model for determining the latent metric describing user actions occurring after the threshold amount of time after presentation of content items;

select a content item of the identified content items for presentation to the user based on the determined latent metrics; and provide the selected content item to a client device for presentation to the user.

13. The computer program product of claim 12, wherein determine the latent metric describing user actions occurring after the threshold amount of time after presentation of an identified content item for each identified content item comprises:

determine likelihoods of the user performing one or more interactions with the identified content item from the retrieved models, characteristics of the user, and characteristics of the identified content item;

for each of the retrieved models, apply a weight associated with a model to a likelihood of the user performing a determined likelihood of the user performing the interaction associated with the model; and combine the determined likelihoods of the user performing one or more interactions with the identified content item after application of the weights to determine the latent metric describing user actions occurring after the threshold amount of time after presentation of the identified content item.

14. The computer program product of claim 13, wherein combine the determined likelihoods of the user performing one or more interactions with the identified content item after application of the weights to determine the latent metric describing user actions occurring after the threshold amount of time after presentation of the identified content item comprises determining a sum of the determined likelihoods of the user performing one or more interactions with the identified content item after application of the weights.

15. The computer program product of claim 12, wherein select the content item of the identified content items for presentation to the user based on the determined latent metrics comprises:

rank the identified content items based on the determined latent metrics; and select an identified content item having at least a threshold position in the ranking.

16. The computer program product of claim 12, wherein select the content item of the identified content items for presentation to the user based on the determined latent metrics comprises:

select an identified content item having a maximum latent metric.

17. The computer program product of claim 12, wherein one or more of the identified content items are associated with bid amounts specifying amounts of compensation provided to the online system for presenting the one or more identified content items.

18. The computer program product of claim 17, wherein select the content item of the identified content items for presentation to the user based on the determined latent metrics comprises:

modifying amounts associated with the one or more identified content items based on the determined latent metrics, wherein a bid amount is associated with an identified content item modified by an amount that is proportional to the determined latent metric for the identified content item; and select the content item of the identified content items based on the modified bid amount.

19. The computer program product of claim 18, wherein select the content item of the identified content items based on the modified bid amount comprises:

select an identified content item associated with a maximum modified bid amount.

20. The computer program product of claim 18, wherein select the content item of the identified content items based on the modified bid amount comprises:

rank the one or more identified content items based on the modified bid amount associated with the one or more identified content items; and select an identified content item having at least a threshold position in the ranking.

21. The computer program product of claim 12, wherein a model maintained by the online system for determining a likelihood of users performing an interaction with a presented content item within the threshold amount of time after presentation of the presented content items is selected from a group consisting of: a model determining a likelihood of users accessing the presented content item, a model determining a likelihood of users performing a specific interaction with the presented content item, a model determining a likelihood of users performing a specific interaction with an object associated with the presented content item, a model determining an amount of time users will view the presented content item, and any combination thereof.

* * * * *